US011151955B2

(12) United States Patent
Liu

(10) Patent No.: US 11,151,955 B2
(45) Date of Patent: Oct. 19, 2021

(54) DISPLAY PANEL AND METHOD FOR DRIVING SAME

(71) Applicant: HKC Corporation Limited, Guangdong (CN)

(72) Inventor: Zhongnian Liu, Guangdong (CN)

(73) Assignee: HKC Corporation Limited, Guangdong (CN)

( * ) Notice: Subject to any disclaimer, the term of this patent is extended or adjusted under 35 U.S.C. 154(b) by 0 days.

(21) Appl. No.: 17/041,626

(22) PCT Filed: Nov. 30, 2018

(86) PCT No.: PCT/CN2018/118627

§ 371 (c)(1),
(2) Date: Sep. 25, 2020

(87) PCT Pub. No.: WO2020/098005

PCT Pub. Date: May 22, 2020

(65) Prior Publication Data

US 2021/0027735 A1 Jan. 28, 2021

(30) Foreign Application Priority Data

Nov. 12, 2018 (CN) ..... 201811339251.7

(51) Int. Cl.
*G09G 3/36* (2006.01)

(52) U.S. Cl.
CPC ..... *G09G 3/3677* (2013.01); *G09G 3/3614* (2013.01); *G09G 3/3688* (2013.01)

(58) Field of Classification Search
CPC ... G09G 3/3677; G09G 3/3614; G09G 3/3688
See application file for complete search history.

(56) References Cited

U.S. PATENT DOCUMENTS 7,173,600 B2 2/2007 Kodate et al.
2005/0083319 A1 4/2005 Kodate et al.
(Continued)

FOREIGN PATENT DOCUMENTS

CN 1744179 A 3/2006
CN 1901766 A 1/2007
(Continued)

OTHER PUBLICATIONS

International Search Report for Application No. PCT/CN2018/118627 dated Jul. 17, 2019, 3 pages.
(Continued)

*Primary Examiner* — Kenneth B Lee, Jr.
(74) *Attorney, Agent, or Firm* — Seyfarth Shaw LLP

(57) ABSTRACT

A display panel of the present application comprises a driving module. The driving module controls a scan line connected to a sub-pixel to provide a scan signal, and a precharge signal sent earlier than the scan signal. A data signal has the same polarity when the scan line is providing the precharge signal and the scan signal. When the display panel is being driven, the precharge signal can be provided to the sub-pixel before the scan signal is provided to the sub-pixel, and when the polarity of the data signal is the same as the polarity of the data signal when the scan signal is provided to the sub-pixel, so as to turn on and precharge the sub-pixel.

20 Claims, 5 Drawing Sheets

(56) References Cited

U.S. PATENT DOCUMENTS

| | | | | |
|---|---|---|---|---|
| 2009/0085849 | A1 | 4/2009 | Chung et al. | |
| 2013/0155035 | A1* | 6/2013 | Chen | G09G 3/20 345/204 |
| 2016/0365045 | A1* | 12/2016 | Chen | G09G 3/3677 |
| 2018/0012554 | A1 | 1/2018 | Chen et al. | |

FOREIGN PATENT DOCUMENTS

| | | | |
|---|---|---|---|
| CN | 102063878 | A | 5/2011 |
| CN | 102592537 | A | 7/2012 |
| CN | 104317086 | A | 1/2015 |
| CN | 105810174 | A | 7/2016 |

OTHER PUBLICATIONS

Chinese Office Action for Application No. 201811339251.7 dated Aug. 27, 2019, 10 pages.

* cited by examiner

DISPLAY PANEL AND METHOD FOR DRIVING SAME

CROSS REFERENCE

This application is a U.S. National Stage application of, and claims priority to, PCT/CN2018/118627, filed Nov. 30, 2018, which further claims priority to Chinese Patent Application No. 201811339251.7, filed Nov. 12, 2018, the entire contents of which are incorporated herein in their entirety.

TECHNICAL FIELD

The present disclosure relates to the technical field of display, and in particular, relates to a display panel and a driving method thereof.

BACKGROUND

The statements herein provide only background information related to the present disclosure and do not necessarily constitute prior art.

With the development of display technology, a half-source driving (HSD) technology is introduced. In the display panel of the HSD, two adjacent sub-pixels share one data line. As such, the data lines thereof can be reduced by half as compared with the exemplary display panel. Meanwhile, in the HSD display panel, sub-pixels spaced apart from each other in the same row are connected to the same scan line, and adjacent sub-pixels in the same row are connected to different scan lines. Thus, the number of scan lines thereof is doubled with respect to the exemplary display panel.

In a liquid crystal display panel, a sub-pixel include a thin film transistor. A scan line is connected to the gate of the thin film transistor for providing a scan signal to turn on the sub-pixel; the data line is connected to a source stage of the thin film transistor for providing a data signal for charging the sub-pixel. Due to the delay effect of the RC signal, the waveform of the data signal is not an ideal square wave but has a starting end and a trailing end. The data signal gradually rises toward a predetermined value at the starting end of the waveform and reaches the predetermined value at the trailing end of the waveform. Therefore, in the same waveform of the data signal, the sub-pixel turned on by the scan signal corresponding to the starting end is under-charged and the brightness is low. The sub-pixel turned on by the scan signal corresponding to the trailing end is sufficiently charged and the brightness is high In the display panel of the HSD, when the image refresh frequency per second is constant, the scan lines are doubled and the turn-on time of each sub-pixel is shortened, and the charge difference of the sub-pixels caused by the delay of the data signal becomes obvious, resulting that the display of sub-pixels is uneven, for example, a vertical bright-dark line is generated.

SUMMARY

Accordingly, it is necessary to provide a display panel that can improve the display uniformity of each of the sub-pixels to address the foregoing technical problems.

A display panel includes:

scan lines extending in a first direction and configured to provide a scan signal;

data lines extending in a second direction, arranged intersecting the scan line and configured to provide a data signal in a square-wave form, a waveform of the data signal having a starting end where a polarity of the data signal is inverted and gradually rises to a predetermined value, and a trailing end where the data signal reaches the predetermined value;

a sub-pixel group, connected to the scan lines and the data lines, the sub-pixel group includes a sub sub-pixel and a positive sub-pixel, when the scan signal is turned on, the sub sub-pixel is charged through the data signal at the starting end, and the positive sub-pixel is charged through the data signal at the trailing end; and a driving module, connected to the scan lines and the data lines and configured to control signal output of the scan lines and the data lines, the driving module controls the scan line connected to the sub sub-pixel to provide the scan signal and a precharge signal prior to the scan signal, the polarity of the data signal when the precharge signal is provided by the scan line is the same as that when the scan signal is provided by the scan line, and the driving module controls the scan line connected to the positive sub-pixel to provide a scan signal.

In one of the embodiments, the scan lines are arranged in a plurality of rows in the second direction, a period of time of the scan signal provided by each of the scan lines is defined as T, and an output mode of the data signal controlled by the driving module is that after the scan signal is applied, the polarity of the data signal is inverted for one time after one T, and is inverted every mT, where in is a positive integer greater than or equal to 2;

the scan line connected to the sub sub-pixel is located in a 2nd row and a $2+(n_1)$mth row, where $n_1$ is a positive integer;

a period the driving module controlling the precharge signal provided by the scan line connected to a same sub sub-pixel prior to the scan signal is $t_1$, $(2m(n_2)-1)T \le t_1 \le 2m(n_2)$, and T is a positive integer.

In one of the embodiments, m=2.

In one of the embodiments, $n_2=1$.

In one of the embodiments, m=2, $n_2=1$, and $t_1=3T$.

In one of the embodiments, m=2, $n_2=1$, and $t_1=4T$.

In one of the embodiments, the scan lines are arranged in a plurality of rows in the second direction, a period of time of the scan signal provided by each of the scan lines is defined as T, and an output mode of data signal controlled by the driving module is that after the scan signal is applied, the polarity of the data signal is inverted every mT, where in is a positive integer greater than or equal to 2;

the scan line connected to the sub sub-pixel is located in a 1st row and a 1+(n3)mth row, where $n_3$ is a positive integer; and a period the driving module controlling the precharge signal provided by the scan line connected to a same sub sub-pixel prior to the scan signal is $t_2$, $(2m(n_4)-1)T \le t_2 \le 2m(n_4)T$, where $n_4$ is a positive integer.

In one of the embodiments, m=2.

In one of the embodiments, $n_4=1$.

In one of the embodiments, m=2, $n_4=1$, and $t_2=3T$.

In one of the embodiments, m=2, $n_4=1$, and $t_2=4T$.

In one of the embodiments, m=3.

In one of the embodiments, m=3, $n_4=1$, and $t_2=5T$.

In one of the embodiments, m=3, $n_4=1$, and $t_2=6T$.

In one of the embodiments, the scan line connected to the sub sub-pixel is further located in a 2nd row and a $2+(n_3)$mth row.

In one of the embodiments, m=3.

In one of the embodiments, a period of time of the precharge signal provided by the scan lines in the 1st row and the $1+(n_3)$mth row is $t_3$, a period of time of the precharge signal provided by the scan lines in the 2nd row and the $2+(n_3)$mth row is t4, and the driving module controls that $t_4<t_3$.

A driving method of a display panel is provided. The driving method is configured to drive the display panel.

The display panel includes:

scan lines extending in a first direction and configured to provide a scan signal;

data lines extending in a second direction and arranged intersecting the scan line and configured to provide a data signal in a square-wave form, the waveform of the data signal having a starting end where a polarity of the data signal is inverted and gradually rises to a predetermined value, and a trailing end where the data signal reaches the predetermined value;

a sub-pixel group, connected to the scan lines and the data lines, the sub-pixel group includes a sub sub-pixel and a positive sub-pixel, and when the scan signal is turned on, the sub sub-pixel is charged through the data signal at the starting end, and the positive sub-pixel is charged through the data signal at the trailing end; and a driving module, connected to the scan lines and the data lines and configured to control signal output of the scan lines and the data lines; the driving module controls the scan line connected to the sub sub-pixel to provide the scan signal and a precharge signal prior to the scan signal, and the polarity of the data signal when the precharge signal is provided by the scan line is the same as that when the scan signal is provided by the scan line, and the driving module controls the scan line connected to the positive sub-pixel to provide a scan signal.

The method includes:

providing a data signal for the sub-pixel group through the data line;

providing a scan signal and a precharge signal prior to the scan signal to the sub sub-pixel through the scan lines connected to the sub sub-pixel under the same data signal polarity; and providing a scan signal for the positive sub-pixel through the scan line connected to the positive sub-pixel.

In one of the embodiments, prior to providing the data signal, further includes:

obtaining an output mode of data signal; and determining a position of a scan line connected to the sub sub-pixel and a position of a scan line connected to the positive sub-pixel based on the output mode of data signal.

In one of the embodiments, the precharge signal has a precharge period determined according to a precharging quantity requirement of the sub sub-pixel and a magnitude of a corresponding data signal.

The details of one or more embodiments of the invention are set forth in the accompanying drawings and the description below.

DETAILED DESCRIPTION OF THE EMBODIMENTS

The present disclosure will be described in details in combination with the accompanying drawings and embodiments such that the purpose, technical solution and advantages of the present disclosure will be more apparent. It should be understood that the particular embodiments are described for the purpose of illustrating as opposed to restricting the present disclosure.

The display panel provided in the present disclosure can be applied to a liquid crystal display device or a liquid crystal display apparatus, for example, a liquid crystal display screen, a liquid crystal television, etc.

Figure 1:
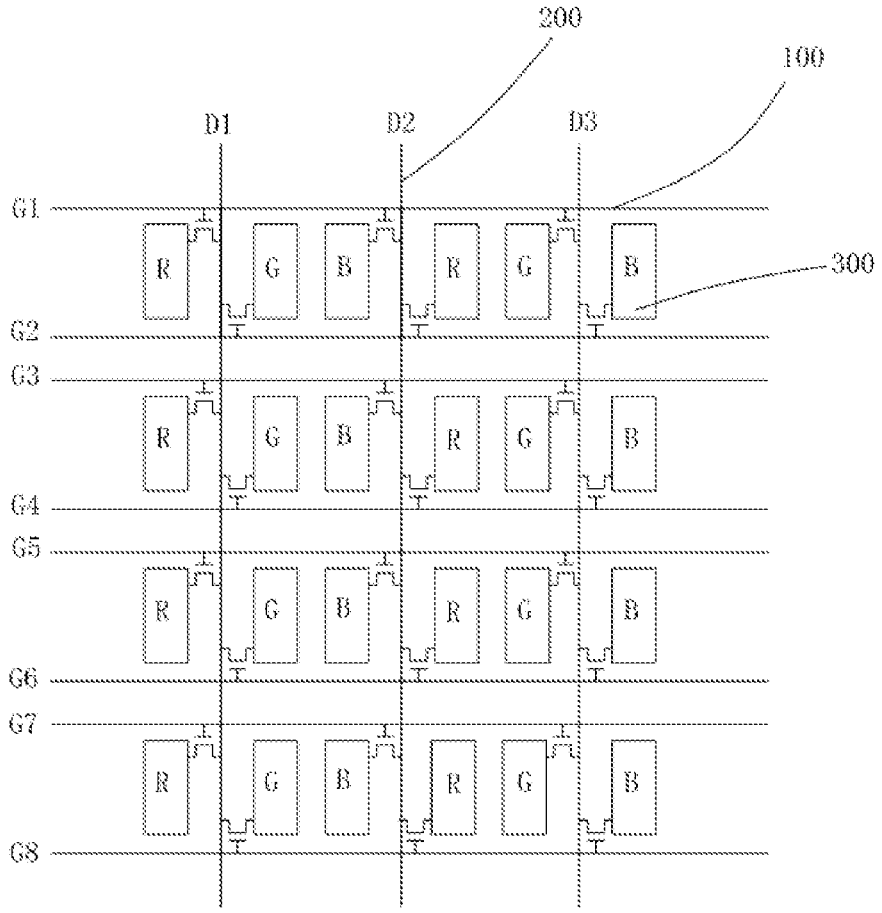
FIG. 1 is a schematic diagram of a pixel array of a display panel according to an embodiment.

As shown in FIG. 1, in an embodiment, a display panel is provided, which includes scan lines 100, data lines 200, and a sub-pixel group 300, and a driving module (not shown).

Figure 2:
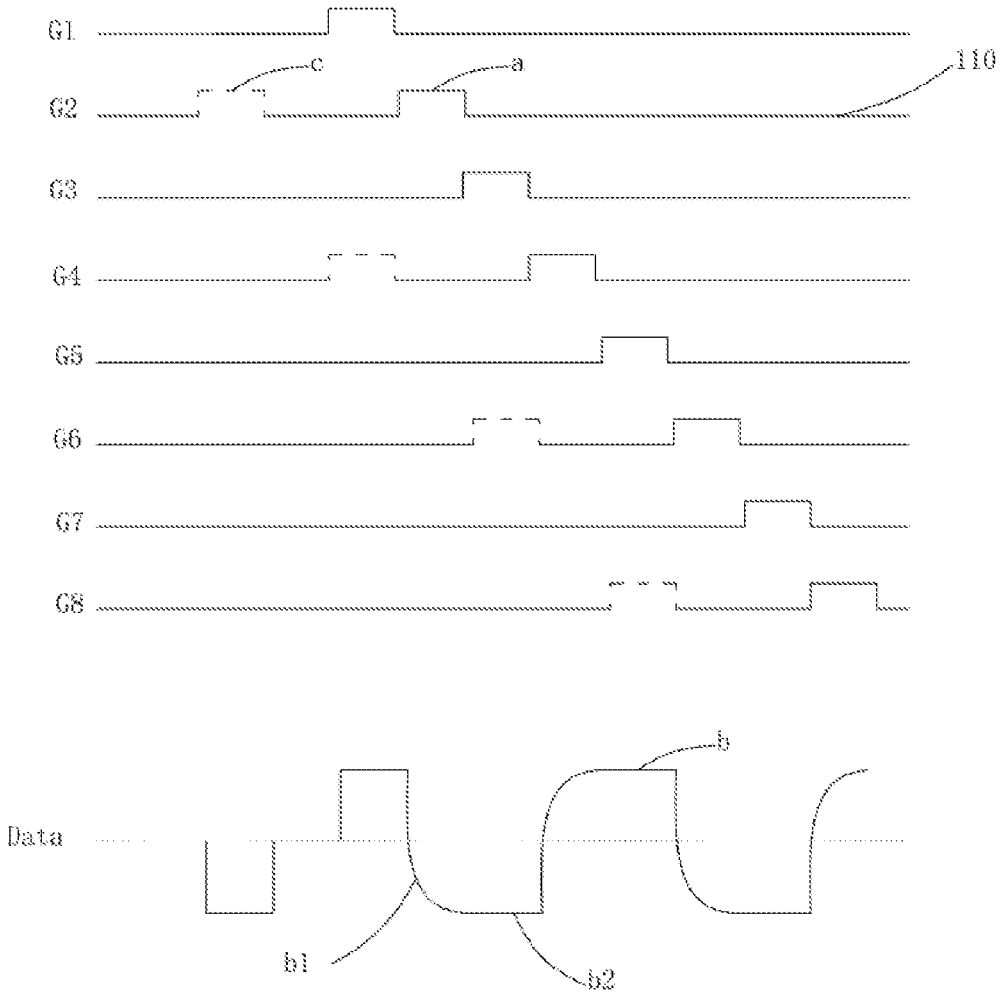
FIGS. 2-5 are schematic diagrams of driving waveforms of scan signals on scan lines and data signals on data lines according to different embodiments.

Referring to FIGS. 1 and 2, the scan lines 100 extend in a first direction and are configured to provide a scan signal a. The data lines 200 extend in a second direction and are configured to provide a data signal b in a square-wave form. Specifically, the first direction may be a horizontal direction and the second direction may be a vertical direction (referring to FIG. 1). The actual numbers of the scan lines 100 and the data lines 200 are both plural (the scan lines G1-G8 and the data lines D1-D3 shown in FIG. 1 are merely illustrative, and the actual numbers of the scan lines 100 and the data lines 200 of the present disclosure are not limited thereto), and the scan lines 100 and the data lines 200 are arranged intersecting each other and limiting a plurality of sub-pixel areas. The sub-pixel area has a red sub-pixel R, a green sub-pixel G, a blue sub-pixel B, etc.

The display panel in the embodiment of the present disclosure is driven in a half-source driving (HSD) manner. Referring to FIG. 2, a waveform of the data signal b provided by the data line 200 is bent at a voltage inversion position due to a RC signal delay effect. Specifically, the waveform of the data signal b provided by the data line 200 each has a starting end b1 and a trailing end b2. At the starting end b1 of each waveform, the polarity of the data signal b is inverted (from positive to negative or from negative to positive) and the data signal b gradually rises toward a predetermined value. At the trailing end b2, the data signal b reaches the predetermined value. The sub-pixel group 300 is connected to the scan line 100 and the data line 200, and includes a sub sub-pixel 310 and a positive sub-pixels (not labeled) located in each sub-pixel area. Specifically, the sub sub-pixel 310 and the positive sub-pixel each includes a thin film transistor, a pixel electrode connected to the drain of the thin film transistor, a common electrode disposed opposite to the pixel electrode, and liquid crystal molecules between the pixel electrode and the common electrode.

The scan line 100 is connected to a gate of the thin film transistor to provide a scan signal to turn on the sub sub-pixel 310 or the positive sub-pixel. The data line 200 is connected to a source of the thin film transistor to provide a data signal to charge the sub sub-pixel 310 and the positive sub-pixel. When the scan signal is turned on, the sub sub-pixel 310 is charged via the data signal b of the starting end b1, and the sub sub-pixel 310 is therefore insufficiently charged; and the positive sub-pixel is charged via the data signal b at the trailing end b2, and is therefore sufficiently charged. One waveform of the data signal b corresponds to one sub-pixel group 300. The driving module is connected to the scan line 100 and the data line 200 and is configured to control signal output of the scan lines 100 and the data lines 200. Specifically, the driving module may include scan drive and data drive. The scan drive is connected to the scan line 100 and controls the signal output on the scan line 100. The data drive is connected to the data line 200 and controls the signal output on the data line 200.

In the embodiments of the present disclosure, the driving module controls the scan line 100 connected to the sub sub-pixel 310 to provide the scan signal a and a precharge signal c prior to the scan signal a, and the polarity of the data signal b when the precharge signal c is provided by the scan line 100 is and the same as that when the scan signal a is provided by the scan line 100. Also, the driving module controls the scan line 100 connected to the positive sub-pixel to provide the scan signal a.

Therefore, when the display panel is driven, a precharge signal c can be supplied to the sub sub-pixel 110 when the polarity of the data signal b is the same with the polarity of the data signal b when the scan signal a is provided to the sub sub-pixel, so as to turn on and precharge the sub sub-pixel. After being turned on later again by the scan signal a, the pre-charged sub-pixel 110 is further re-charged under the data signal b of the same polarities, and the charged quantity is effectively increased. As such, in the display panel provided in the present disclosure, by providing the precharge signal c, the sub sub-pixels are sufficiently charged to compensate for the insufficient charging of the sub sub-pixels due to the delay of the data signal b, thereby improving the display uniformity of the sub-pixels.

Figure 3:
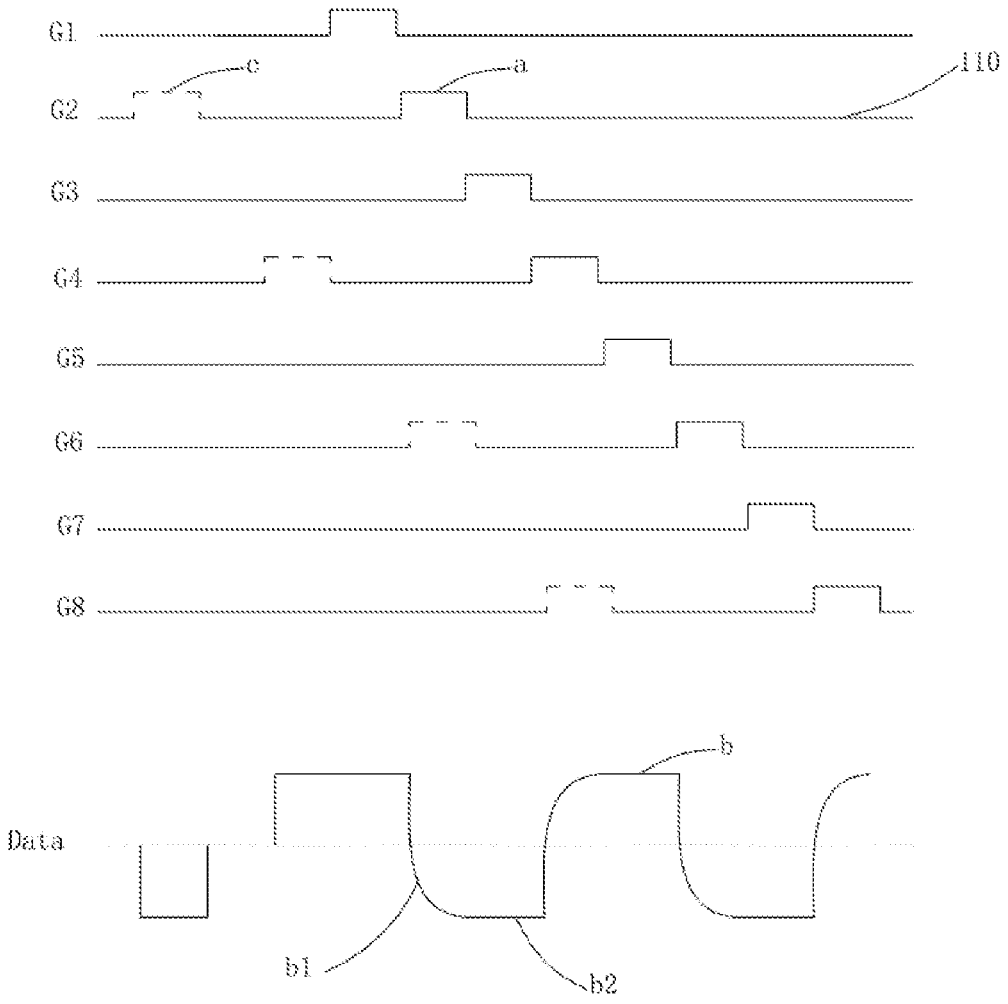

In an embodiment, referring to FIGS. 2 and 3, the scan lines 100 are arranged in a plurality of rows in a second direction (vertical direction). A period of time of a scan signal a provided by each row of scan lines 100 is T. An output mode of the data signal b controlled by the driving module is that after the scan signal a is applied, the polarity of the data signal b is inverted for one time after one T, and is inverted every mT, where m is a positive integer greater than or equal to 2. That is, after the scan signal a is applied, the data signal b drives the sub-pixels in a mode of 1+(m) line (for example, 1+2 line). At this time, when the scan signal a is provided by the first scan line 100, the corresponding data signal b rises from 0V to a predetermined value, rather than from the opposite polarity value to the predetermined value, and the charging is fast and sufficient.

When the scan lines 100 of the 2nd row and the $2+(n_1)$mth ($n_1$ is a positive integer) row are providing the scan signal a, the corresponding data signal b is inverted and its value gradually rises to the predetermined value. It is the sub sub-pixel 310 which is connected to the scan lines 100 of the 2nd row and the $2+(n_1)$mth row, i.e., the scan lines 100 connected to the sub sub-pixel 310 are located in the 2nd row and the $2+(n_1)$mth row. As can be determined from the diagram, in addition to the scan signal a, the scan line connected to the sub sub-pixel 310 also provides a precharge signal c. It should be noted that in the diagram, the period of time of the precharge signal c provided by the sub scan line 110 is illustrative only, and can be adjusted according to requirements in practical applications.

In this case, a period the precharge signal c being provided by the scan lines 100 connected to the same sub sub-pixel prior to the scan signal a is $t_1$, then the range of $t_1$ can be controlled by the driving module is $(2m(n_2)-1)T \le t_1 \le 2m(n_2)T$, with $n_2$ being a positive integer, so as to ensure that the polarities of the data signal are the same when the scan lines 100 connected to the same sub sub-pixel 310 are providing the precharge signal c and the scan signal a. On the basis that $(2m(n_2)-1)T \le t_1 \le 2m(n_2)T$ is satisfied, $t_1$ may be set to be an integer multiple of T, so that the precharge signal c of a sub sub-pixel is only turned on simultaneously with the previous row of scan signal a to precharge the sub sub-pixel. As such, the voltage in precharging is stable and consistent, and it is convenient to set the precharge time to charge according to the actual charge quantity demand.

Specifically, it can be configured that m=2, $n_2=1$, and $t_1=3T$ (referring to FIG. 2) or 4T (referring to FIG. 3). m=2, then after the scan signal a is applied, the data signal b drives the sub-pixels in a mode of 1+2 line (in this drive mode, vertical bright-dark lines will appears in the exemplary HSD display panel, where the odd columns of sub-pixels 300 are relatively bright, and even columns of sub-pixels 300 are relatively dark). $n_2=1$, the applying time of the signal (the scan signal a, data signal b, and precharge signal c) can be shortened for one frame. On the premise that m=2, $n_2=1$, then $t_1=3T$ or 4T, so that the precharge signal c of the sub sub-pixel is only turned on simultaneously with the scan signal a of the first 3 rows or the first 4 rows to precharge the sub sub-pixel 310.

In the foregoing embodiment, the precharge signal c provided by each of the scan lines 100 connected to the sub sub-pixel 310 has the same period of time $t_1$ prior to the scan signal a, which is 3T or 4T, so as to facilitate system configuration. Of course, this application is not limited herein. The period $t_1$ the precharge signal c being provided by each of the scan lines 100 connected to the sub sub-pixel 310 prior to the scan signal a may be different, for example, the period $t_1$ the precharge signal c being provided by some of the scan lines 100 connected to the sub sub-pixel 310 prior to the scan signal a may be 4T, and the period $t_1$ the precharge signal c being provided by some of the scan lines 100 connected to the sub sub-pixel 310 prior to the scan signal a may be 3T.

The drive mode of the data signal b of the scan lines 100 and the data lines 200 connected to the sub sub-pixels 310 may be different from the above embodiments.

Figure 4:
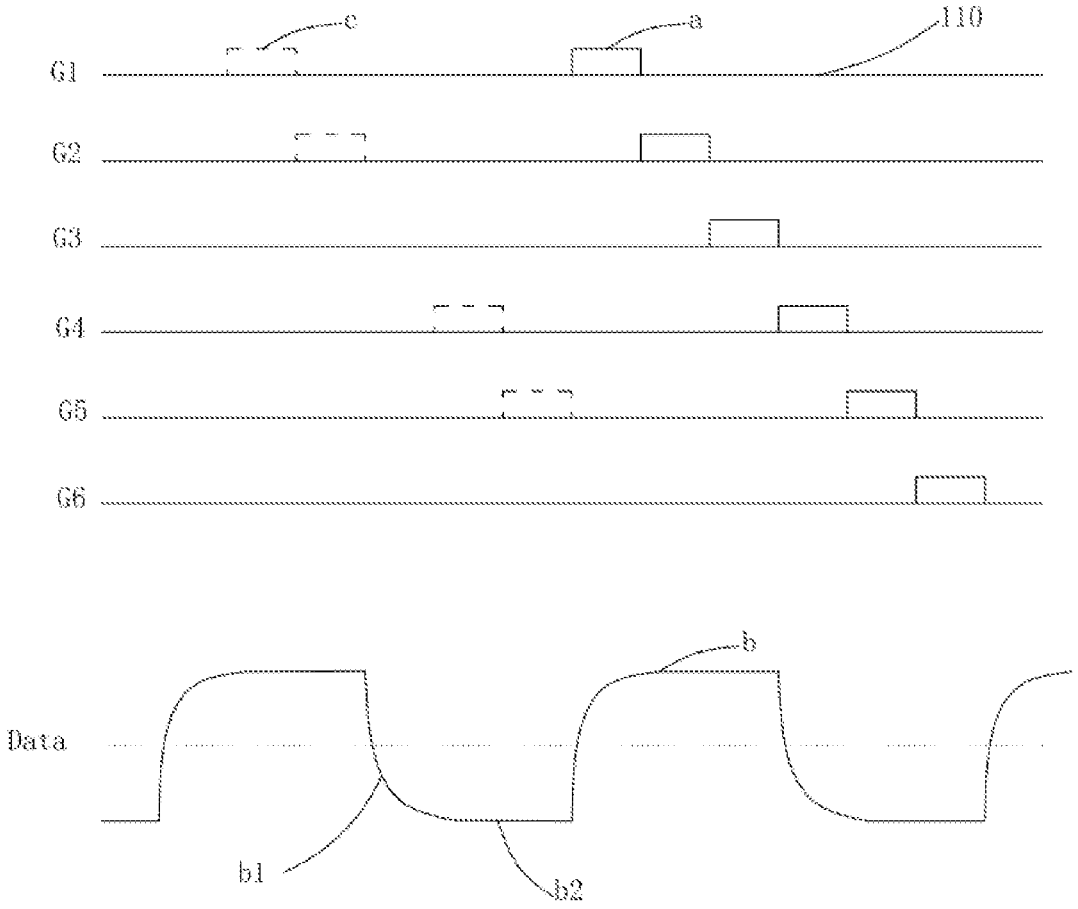
Figure 5:
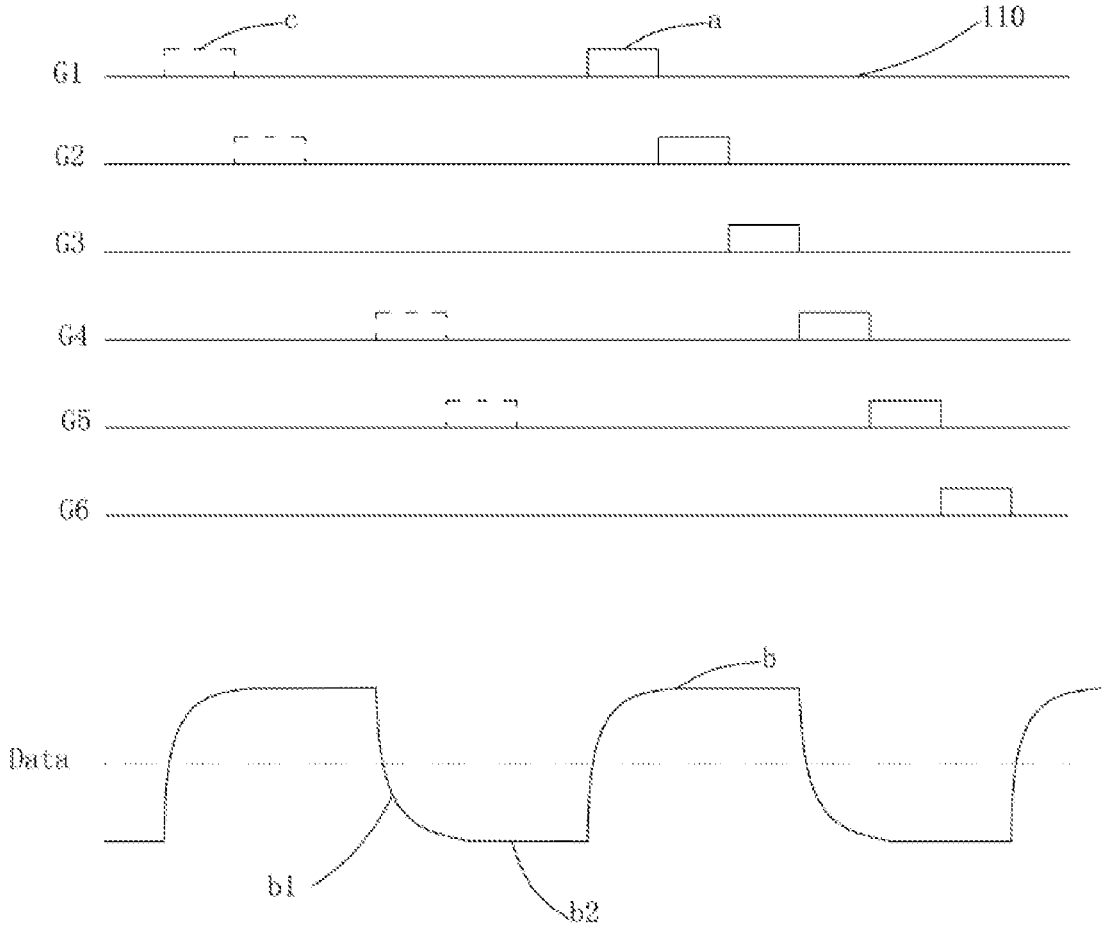

In another embodiment of the present disclosure, referring to FIGS. 4 and 5, the scan lines 100 are also arranged in a plurality of rows in the second direction (vertical direction). The period of time of a scan signal provided by each row of scan lines is defined as T. The output mode of data signal b controlled by the driving module is that after the scan signal is applied, the polarity of the data signal is inverted every mT, and m is a positive integer greater than or equal to 2. At this time, when the scan signal a is provided by the first row of scan lines 100, the polarity of the corresponding data signal b is inverted and the data signal b rises to a predetermined value, so that the first row of the scan lines 100 are connected to the negative sub-pixels 310.

The polarity of the data signal is inverted every mT, when the scan line 100 of the $(1+(n_3)m)$th ($n_3$ is a positive integer) row is providing the scan signal a, the value also rises from the opposite polarity value to the predetermined value. Therefore, the scan line 100 of the $1+(n_3)$mth line is also connected to the sub sub-pixel 310. Therefore, the scan line 100 connected to the sub sub-pixel 310 is located on the 1st line and the $1st+(n_3)$mth line. It can be determined from the diagram that the scan line 100 connected to the sub sub-pixel 310 provides not only the scan signal a but also the precharge signal c. It should be noted that, in the diagram, the period of time of the precharge signal c provided by the scan line 100 connected to the subpixel 310 is illustrative only, and can be adjusted according to requirements in practical applications.

In this case, a period the precharge signal c being provided by the scan lines 100 connected to the same sub sub-pixel prior to the scan signal a is $t_2$, then the range of $t_2$ controllable by the driving module is $(2m(n_4)-1)T \le t_2 \le 2m(n_4)T$, with $n_4$ being a positive integer, so as to ensure that the polarities of the data signal are the same when the scan lines 100 connected to the same sub sub-pixel 310 are providing the precharge signal c and the scan signal a. On the basis that $(2m(n_4)-1)T \le t_2 \le 2m(n_4)T$ is satisfied, $t_2$ may be set to be an integer multiple of T, so that the precharge signal c of a sub sub-pixel is only turned on simultaneously with the previous row of scan signal a to precharge the sub sub-pixel. As such, the voltage in precharging is stable and consistent, and it is convenient to set the precharge time to charge according to the actual charge quantity demand.

Specifically, it can be configured that m=3, $n_4$=1, and $t_1$=5T (referring to FIG. 2) or 4T (referring to FIG. 3). m=3, then after the scan signal a is applied, the data signal b drives the sub-pixels in a mode that inverts every 3T. $n_4$=1, the applying time of the signal (the scan signal a, data signal b, and precharge signal c) can be shortened for one frame. On the premise that m=3, $n_4$=1, then $t_2$=5T or 6T, so that the precharge signal c of the sub sub-pixel is only turned on simultaneously with the scan signal a of the first 5 rows or the first 6 rows to precharge the sub sub-pixel.

Alternatively, m may be set to 2 and $n_4$ may be set to 1. When m=2, $n_4$=1, it can be configured $t_1$=3T or 4T etc.

Referring to the figure, the data signal b rises slowly at the starting end $b_1$. If its rise time exceeds one T, two rows of scan lines 100 are successively signaled during the rise time. Therefore, the scan lines 100 connected to the sub sub-pixel 310 is also located in the 2nd row and the 2+($n_3$)mth row in addition to the 1st row and the 1+($n_3$)mth row. In this case, it is defined that the period of time of the precharge signal c provided by the scan lines 100 in the 1st row and the 1+($n_3$)mth row is $t_3$, the period of time of the precharge signal provided by the sub scan lines of the 2nd row and the 2+(n3)mth row is $t_4$. Then since the corresponding data signal b is relatively high when the 2nd row and the 2+(n3)mth row of scan lines 100 are applied with the scan signal a, the charge quantity is relatively sufficient, that is, the amount of energy to be replenished is small, as such, the drive module controls $t_4 < t_3$ to perform precharging according to the actual charging demand.

In the above embodiment, the precharge signal c provided by each of the scan lines 100 connected to the sub sub-pixel 310 has the same period of time $t_2$ prior to the scan signal a, which is 5T or 6T so as to facilitate system configuration. Of course, this application is not limited herein. The period $t_2$ the precharge signal c being provided by each of the scan lines 100 connected to the sub sub-pixel 310 prior to the scan signal a may be different, for example, the period $t_2$ the precharge signal c being provided by some of the scan lines 100 connected to the sub sub-pixel 310 prior to the scan signal a may be 6T, and the period $t_2$ the precharge signal c being provided by some of the scan lines 100 connected to the sub sub-pixel 310 prior to the scan signal a may be 5T.

In an embodiment, a driving method of the display panel described above is also provided, which includes the following steps.

In step S1, a data signal b is provided for the sub-pixel group 300 through the data lines 200.

In step S2, a scan signal a and a precharge signal c prior to the scan signal a are supplied to the sub sub-pixels through the scan lines 100 connected to the sub sub-pixels 310 under the same data signal polarity.

In step S3, a scan signal a for the positive sub-pixel is provided by the scan line 100 connected to the positive sub-pixel.

In the above steps, S1 to S3 are not performed in chronological order. In actual driving, the scan line 100 and the data line 200 can be driven by a driving module, and a signal is simultaneously applied to the scan line 100 and the data line 200. Specifically, in the actual driving of the entire display panel, the data line 200 provides the data signal b. Each of the scan lines 100 provides a scan signal a row by row, and the scan line simultaneously provides a precharge signal c for per row of sub-pixels 310.

For a sub sub-pixel 310, when the polarity of the data signal a is the first polarity (positive polarity or negative polarity), the scan line 100 connected thereto provides a precharge signal thereto, and the sub sub-pixel 310 is turned on to precharge the sub sub-pixel 310. The period of time of a scan signal a provided by each row of scan lines 100 is T. The polarity of the data signal b in the square-wave form on the data line b is repeatedly inverted between positive and negative, and after several T passes, the polarity of the data signal b returns to the first polarity. A scan signal a is supplied to the sub sub-pixel through the scan line 100 connected to the sub sub-pixel 310, and the sub sub-pixel is turned on and recharged. The re-charging of the sub sub-pixels is performed on the basis of pre-charging, so that the sub sub-pixels can be charged sufficiently to normally emit light for display, and display unevenness of the display panel can be improved.

In an embodiment, the display panel may also provide a variety of output modes of the data signal. At this time, for different output modes of the data signal, the position distributions of the sub sub-pixel 310 and the positive sub-pixel are different. Therefore, the driving method of the display panel, before the providing of the data signal b, further includes the following steps.

In step S01, an output mode of data signal b is obtained.

In step S02, a position of a scan line 100 connected to the sub sub-pixel 310 and a position of a scan line connected to the positive sub-pixel are determined based on the output mode of data signal b.

The above steps can be implemented by the driving module.

The precharge signal c has a precharge period of time, which in an embodiment is determined according to the charge quantity requirement of the precharging of the sub-pixel 310 and the magnitude of the corresponding data signal b.

For some sub sub-pixels 310 whose number of row is greater than a certain value, when the precharge signal c thereof is turned on, the corresponding scan signal a corresponding to a predetermined number of row is simultaneously turned on. The value of the corresponding data signal b is the value of the operating voltage when the scan signal a is turned on. If the value is large, the charging is fast, otherwise the charging is slow.

Therefore, the precharge period of time providing the precharge signal c may be determined according to the charge quantity requirement of the precharging of the sub sub-pixel 310 and the magnitude of the corresponding data signal b.

Of course, in actual display, if the display brightness required by the sub sub-pixels is 0, that is, the charge quantity requirement of the precharge is 0V, the precharge period of the precharge signal can be adjusted to 0 s.

The foregoing respective technical features involved in the respective embodiments can be combined arbitrarily, for brevity, not all possible combinations of the respective technical features in the foregoing embodiments are described, however, to the extent they have no collision with each other, the combination of the respective technical features shall be considered to be within the scope of the description.

What is claimed is:

1. A display panel, comprising:

scan lines extending in a first direction and configured to provide a scan signal;

data lines extending in a second direction, arranged intersecting the scan lines, and configured to provide a data signal in a square-wave form, wherein a waveform of the data signal has a starting end wherein a polarity of the data signal is inverted and gradually rises to a predetermined value, and a trailing end where the data signal reaches the predetermined value;

a sub-pixel group, connected to the scan lines and the data lines, wherein the sub-pixel group comprising a sub sub-pixel and a positive sub-pixel, wherein when the scan signal is turned on, the sub sub-pixel is charged through the data signal at the starting end, and the positive sub-pixel is charged through the data signal at the trailing end; and a driving module, connected to the scan lines and the data lines and configured to control signal output of the scan lines and the data lines, wherein the driving module controls the scan line connected to the sub sub-pixel to provide the scan signal and a pre-charge signal prior to the scan signal, wherein polarity of the data signal when the pre-charge signal is provided by the scan line is the same as when the scan signal is provided by the scan line, and wherein the driving module controls the scan line connected to the positive sub-pixel to provide a scan signal, wherein the scan lines are arranged in rows in the second direction, and a period of time of the scan signal provided by each of the scan lines is defined as T; and wherein the driving module is configured to control the data signal to output in either of a first output mode and a second output mode, wherein in the first output mode, after the scan signal is applied, the polarity of the data signal is inverted for one time after one T, and is inverted every mT, m is a positive integer greater than or equal to 2, and a period the driving module controlling the pre-charge signal provided by the scan lines connected to a same sub sub-pixel prior to the scan signal is $t_1$, wherein $(2m(n_2)-1)T \le t_1 \le 2m(n_2)$, and $n_2$ is a positive integer, and wherein in the second output mode, after the scan signal is applied, the polarity of the data signal is inverted every m 'T, where m' is a positive integer greater than or equal to 2, and a period the driving module controlling the pre-charge signal provided by the scan lines coupled to a same sub sub-pixel prior to the scan signal is $t_2$, where $(2m'(n_4)-1)T \le t_2 \le 2m'(n_4)T$, and $n_4$ is a positive integer.

2. The display panel according to claim 1, wherein when the driving module controls the data signal to output in the first output mode, the scan lines connected to the sub sub-pixel is located in a 2nd row and a $2+(n_1)$ mth row, where $n_1$ is a positive integer.

3. The display panel according to claim 2, wherein m=2.

4. The display panel according to claim 2, wherein n2=1.

5. The display panel according to claim 2, wherein m=2, $n_2=1$, and $t_1=3T$.

6. The display panel according to claim 2, wherein m=2, $n_2=1$, and $t_1=4T$.

7. The display panel according to claim 1, wherein when the driving module controls the data signal to output in second first output mode, the scan lines connected to the sub sub-pixel is located in a 1st row and a $1+(n_3)$mth row, and wherein $n_3$ is a positive integer.

8. The display panel according to claim 7, wherein m'=2.

9. The display panel according to claim 7, wherein $n_4=1$.

10. The display panel according to claim 7, wherein m'=2, $n_4=1$, and $t_2=3T$.

11. The display panel according to claim 7, wherein m'=2, $n_4=1$, and $t_2=4T$.

12. The display panel according to claim 7, wherein m'=3.

13. The display panel according to claim 7, wherein m'=3, $n_4=1$, and $t_2=5T$.

14. The display panel according to claim 7, wherein m'=3, $n_4=1$, and $t_2=6T$.

15. The display panel according to claim 7, wherein the scan line connected to the sub sub-pixel is further located in a 2nd row and a $2+(n_3)$m' th row.

16. The display panel according to claim 15, wherein m'=3.

17. The display panel according to claim 15, wherein a period of time of the pre-charge signal provided by the scan lines in the 1st row and the $1+(n_3)$m'th row is $t_3$, a period of time of the pre-charge signal provided by the scan lines in the 2nd row and the $2+(n_3)$m'th row is $t_4$, and the driving module controls that $t_4<t_3$.

18. A driving method of a display panel, configured to drive the display panel, the display panel comprising: scan lines extending in a first direction and configured to provide a scan signal; data lines extending in a second direction, arranged intersecting the scan lines and configured to provide a data signal in a square-wave form, wherein the waveform of the data signal has a starting end where a polarity of the data signal is inverted and gradually rises to a predetermined value, and a trailing end where the data signal reaches the predetermined value; a sub-pixel group, connected to the scan lines and the data lines, wherein the sub-pixel group comprising a sub sub-pixel and a positive sub-pixel, wherein when the scan signal is turned on, the sub sub-pixel is charged through the data signal at the starting end, and the positive sub-pixel is charged through the data signal at the trailing end; and a driving module, connected to the scan lines and the data lines and configured to control signal output of the scan lines and the data lines, wherein the driving module controls the scan line connected to the sub sub-pixel to provide the scan signal and a pre-charge signal prior to the scan signal, and the polarity of the data signal when the pre-charge signal is provided by the scan line is the same as when the scan signal is provided by the scan line, and wherein the driving module controls the scan line connected to the positive sub-pixel to provide a scan signal, the method comprising:

providing a data signal for the sub-pixel group through the data lines;

providing a scan signal and a pre-charge signal prior to the scan signal to the sub sub-pixel through the scan line connected to the sub sub-pixel under the same data signal polarity; and providing a scan signal for the positive sub-pixel through the scan line connected to the positive sub-pixel.

19. The method according to claim 18, prior to providing the data signal, further comprising:

obtaining an output mode of the data signal; and determining a position of the scan line connected to the sub sub-pixel and a position of the scan line connected to the positive sub-pixel based on the output mode of the data signal.

20. The method according to claim 18, wherein the pre-charge signal has a pre-charge period determined according to a pre-charging quantity requirement of the sub sub-pixel and a magnitude of a corresponding data signal.

* * * * *